United States Patent [19]

Hebel

[11] 4,138,818

[45] Feb. 13, 1979

[54] DRAWING BOARD

[75] Inventor: Walter Hebel, Kirchen, Fed. Rep. of Germany

[73] Assignee: Firma Walter Hebel GmbH & Co., Kirchen, Fed. Rep. of Germany

[21] Appl. No.: 855,934

[22] Filed: Nov. 30, 1977

[30] Foreign Application Priority Data

Oct. 23, 1976 [DE] Fed. Rep. of Germany ..... 2648064
Mar. 17, 1977 [DE] Fed. Rep. of Germany ..... 2711662

[51] Int. Cl.[2] ..... B43I 13/02; B43I 7/02
[52] U.S. Cl. ..... 33/76 R; 33/DIG. 1
[58] Field of Search ..... 282/29 R, 29 A; 281/45 A; 33/76, 75, 79, 80, DIG. 1; 24/201 B, 73 MS; 269/8; 335/285

[56] References Cited

U.S. PATENT DOCUMENTS

| | | | |
|---|---|---|---|
| 3,222,087 | 12/1965 | Keenan | 282/29 A |
| 3,589,016 | 6/1971 | Hebel | 33/76 R |

FOREIGN PATENT DOCUMENTS

| | | | |
|---|---|---|---|
| 1289513 | 2/1969 | Fed. Rep. of Germany | 281/45 A |
| 1294851 | 5/1969 | Fed. Rep. of Germany | 33/76 R |
| 1511441 | 8/1969 | Fed. Rep. of Germany | 33/76 R |

*Primary Examiner*—Harry N. Haroian
*Attorney, Agent, or Firm*—Norman S. Blodgett; Gerry A. Blodgett

[57] ABSTRACT

Drawing board having a clamping bar to hold a sheet of paper in place and having two magnetic portions inclined to one another.

2 Claims, 8 Drawing Figures

VI
V
10
9
3
II
4

4b 2 4 1 4a 5
3

22 6 21
13

32 7 31 8 43

4b 4 4a 5
9 3

10 11 12 9 3 2 4 2 9 12 10 11

41 40 20 19 63

53 29 23 24 30

DRAWING BOARD

BACKGROUND OF THE INVENTION

A writing or drawing board of the type described is already known, being disclosed in German patent specification No. 1,611,811, for example. The clamp bar has a clamping part which rests on, or above, the clamping surface when in the clamping position, and a grip which extends beyond the clamping surface. If the grip is pressed downwards, the clamping part is lifted off the magnetized clamping surface. After it is released, the clamp bar is attracted by the magnetized clamping surface and firmly holds the sheet inserted between that surface and the clamp bar. While the sheet is being introduced between the clamping surface and the clamp bar, the latter must be retained in the release position by hand, until the sheet has been accurately aligned in the position in which it is to be clamped.

An object of the present invention is to provide a writing or drawing board of the type described, in which the clamp bar can be retained by simple means in its release position, without being held by hand, so that a sheet can be easily introduced without obstacle between the clamp bar and the clamping surface and aligned in that position.

SUMMARY OF THE INVENTION

In general, the invention relates to a writing or drawing instrument, and is particularly concerned with such an instrument, which comprises a writing or drawing board and a sheet clamping device for retaining a sheet of paper or the like on the board during a writing or drawing operation. The sheet clamping device, with which the present invention is concerned, comprises a magnetized clamping surface attached to the board and a clamp bar of a material which is magnetically attracted by the clamping surface, the clamp bar being tiltable about a tilting edge between a clamping position over the clamping surface and a release position tilted from the clamping position.

The invention resides in a writing or drawing instrument of the type described, in which the clamping surface is associated with a further magnetized surface which is obliquely positioned in relation to the clamping surface and serves to retain the clamp bar in the release positon, the tilting edge for the clamp bar being constituted by an edge formed between the two magnetized surfaces.

When using the instrument of the present invention, the sheet to be secured is fixed between the clamping surface and that part of the clamp bar overlying that surface, while the remaining part of the clamp bar occupies a position above, but separated from, the further magnetized surface. If the clamp bar is pressed with the finger, it is caused to tilt and thus to release the clamped sheet; at the same time, the clamp bar is attracted by the further magnetized surface and is held thereby in the release position. It retains the clamp bar in its released position, until the clamp bar is returned to the clamping position by applying slight pressure by hand to the clamp bar, to cause tilting in the reverse direction.

The magnetic force applied by the clamping surface is preferably greater than that of the further magnetized surface, because greater force is required for clamping the sheet than for holding the clamp bar in the release position. That objective can be achieved by having different degrees of magnetization, or by making the further magnetized surface smaller than the clamping surface, possibly by adopting a narrower or shorter further magnetic surface.

The clamping surface and the further magnetic surface may be surfaces on separate strips of magnetized material, or may be surfaces of a single profiled strip secured in the board, for example, by means of a dovetail joint.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figures 1, 2, 3, 4, 5, 6, 7, 8:
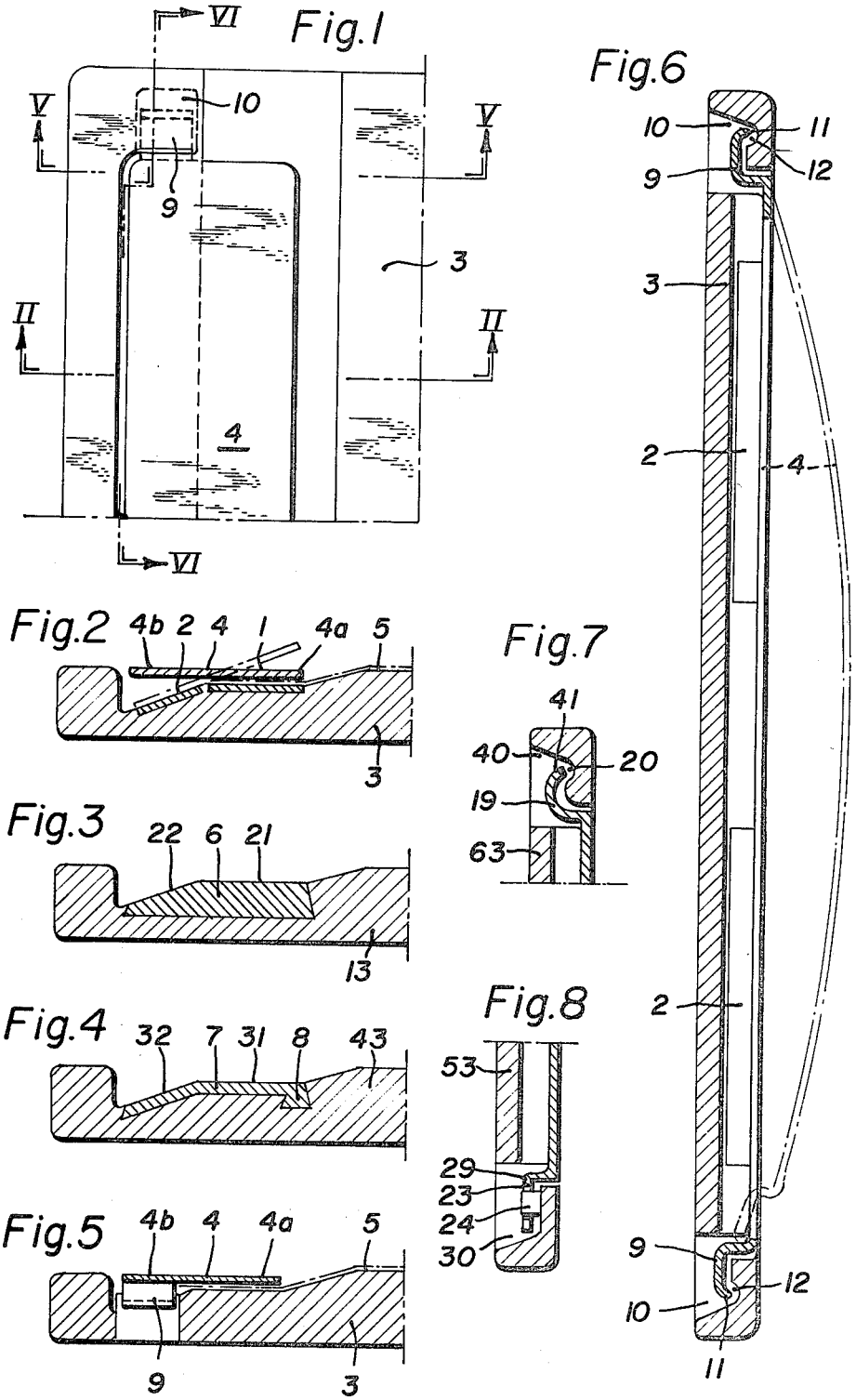
FIG. 1 is a plan view of one portion of the drawing board.
FIG. 2 is a vertical sectional view of the board taken on the line II—II of FIG. 1, FIGS. 3 and 4 are sectional views illustrating two different forms of the board.
FIG. 5 is a sectional view taken on the line V—V of FIG. 1.
FIG. 6 is a sectional view taken on the line VI—VI of FIG. 1, FIGS. 7 and 8 are sectional views of the board showing alternative versions of the clamp bar securing means.

The drawing board, indicated generally by the reference numeral 3, is shown as having a plane upper surface which in use supports a writing or drawing sheet 5. The board 3 incorporates a sheet clamping device which serves to clamp the margin of the sheet 5. The sheet clamping device consists of a clamping surface 1 which is approximately parallel to the plane upper surface and which, as shown, is the upper surface of a magnetized element extending parallel to the left-hand edge of the board 3. A further magnetized surface 2 is attached to the periphery of the board 3, adjacent to, but inclined downwardly relative to, the magnetized clamping surface 1. A tilting edge, extending parallel to the edge of the board, is formed between the two surfaces 1 and 2.

A clamp bar 4 made of a material which is magnetically attracted by the magnetic surfaces 1 and 2 is in the form of a metal strip. The clamp bar has a clamping part 4*a* which overlies the surface 1 and a grip part 4*b* which overlies the surface 2, and can tilt about the edge formed between the two surfaces 1 and 2.

The auxiliary magnetic surface 2 may be formed as the upper surface of a second magnetized strip, as shown in FIG. 2, the two magnetized strips being secured, as by the use of an adhesive, in recesses in the face of the board 3. Alternatively, as shown in FIG. 3, the surfaces 21 and 22 may be formed on a single strip 6 or, as shown in FIG. 4, the surfaces 31 and 32 may be formed on a strip 7. The strip 6 or 7 is shown as secured in the board 3 by use of a dovetailed joint, the lateral faces of the strip 6 or 7 and of the recesses being shaped appropriately for that purpose. However, other methods of securing the strip 6 or 7 are possible, as by injecting or casting the metal of the strip into a dove-tailed groove in the board 3, which may be made of a plastic material.

The clamp bar 4 can tilt about the edge formed between the surfaces 1 and 2 between a clamping position (which is shown in full line in FIG. 2) and a release postion (which is shown in broken lines in FIG. 2). When in the clamping position, the clamping part 4a firmly holds the sheet of paper 5 between itself and the flat clamping surface 1. Then, by pressing the grip part 4b with the fingers, the clamping part 4a can be lifted into the release position in which it is disposed parallel to the magnetized surface 2. The clamp bar 4 is then held in the release position by the magnetic attraction between the magnetized surface 2 and the part 4b. After the insertion of a sheet 3 of paper, the clamping part 4a can be lightly pressed with the fingers in order to lift the grip part 4b off the oblique magnetized surface 2, after which is automatically moves by the attraction of the clamping part 4a, again into the clamping position.

Referring to FIGS. 5 and 6, the clamp bar 4 consists of a flat strip of steel. At its ends, it is curved and bent downwardly, in the grip part 4b to form curved or bent terminal portions 9, which pass through the board 3 and engage in recesses 10 formed on the underside of the board. The clamp bar 4 is secured in position on the board 3 by first inserting only one end into the corresponding recess 10. The clamp bar 4 is then bent or bowed in the manner shown in the broken lines in FIG. 6 until the other end can be similarly introduced into the board, its terminal portion 9 being received in the opposite recess 10 of the board. While the portions 9 of the clamp bar 4 have extremities which are either hook-shaped, the end 19 may be bent in the form of an arc 41 as shown in FIG. 7, and engage cut-back portions of the recesses 20. In FIG. 8, on the other hand, the ends 29 are provided with openings 23, in the form of holes or slits which open to the side edges of the clamp bar, those openings receiving protuberances 24 extending downwardly into the recesses 30.

By means of the engagement of the ends 9 of the clamp bar with the recesses formed in the underside of the board 3, the clamp bar is held securely in position, although it is free to tilt between the clamping position and the release position. The clamp bar cannot accidentally become detached from the plate, unless special measures are taken for that purpose; such measures may consist, for example, of the use of a screwdriver for raising one of the ends 9 so that that end becomes detached from the board 3.

FIGS. 1 and 5 show that the dimensions of the recess 10, transversely of the length of the clamp bar 4, is equal to the width of the end portions 9, plus a slight tolerance. There is a clearance between the end portions 9 and the underside of the board 3, that clearance being sufficient to allow the clamp bar to be raised vertically if necessary, in order to enable a number of sheets of paper 5, or a sheet of relatively thick cardboard, to be clamped to the board 3.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Drawing board, comprising:

(a) a main body having a broad upper surface, (b) a first magnetic portion having an upper surface which is parallel to and extends beside the upper surface of the main body, (c) a second magnetic portion having an upper surface which extends beside the upper surface of the first magnetic portion and is inclined thereto, (d) a clamping bar overlying the upper surfaces of the first and second magnetic portions formed of a material that is attracted to the magnetic portions, and (e) means retaining the clamping bar in position on the main body with sufficient freedom of motion to allow it to selectively contact the upper surface of either the first or the second magnetic portion.

2. Drawing board as recited in claim 1, wherein the clamping bar is in the form of a flexible strip of metal with hooks formed on its ends, and wherein the main body is formed with recesses having surfaces shaped to cooperated with the hooks to maintain the clamping bar in place.

* * * * *